United States Patent [19]

Thies, Jr.

[11] 4,020,658

[45] May 3, 1977

[54] APPARATUS FOR WET-TREATING FABRICS

[76] Inventor: Alfred Thies, Jr., 56 Gerlever Weg, D-4420 Coesfeld, Germany

[22] Filed: May 5, 1975

[21] Appl. No.: 574,305

[30] Foreign Application Priority Data

May 4, 1974 Germany ..... 2427415

[52] U.S. Cl. ..... 68/5 C; 68/27; 68/148; 68/158; 68/177; 68/184

[51] Int. Cl.[2] ..... D06B 3/24; D06B 3/28

[58] Field of Search ..... 68/5 C, 27, 58, 62, 68/148, 152, 158, 177, 178, 181 R, 184, 199, 205 R, 189, 207

[56] References Cited

UNITED STATES PATENTS

| | | | |
|---|---|---|---|
| 2,826,057 | 3/1958 | Olson | 68/148 |
| 3,315,499 | 4/1967 | Westall | 68/189 X |
| 3,330,134 | 7/1967 | Carpenter | 68/178 X |
| 3,631,692 | 1/1972 | Garzotto | 68/178 X |
| 3,718,012 | 2/1973 | Vinas | 68/177 X |
| 3,762,866 | 10/1973 | Rayment et al. | 68/177 X |
| 3,821,883 | 7/1974 | Horie et al. | 68/184 X |
| 3,921,420 | 11/1975 | Aurich et al. | 68/178 X |

*Primary Examiner*—Philip R. Coe
*Attorney, Agent, or Firm*—Werner W. Kleeman

[57] ABSTRACT

An apparatus for wet-treating, particularly for dyeing, a fabric in the form of a continuous circulating rope of cloth, wherein the rope of cloth is fed into a kier by introducing it by means of a treating liquid and is moved farther within the kier. The treating liquid is circulated through outlets out of the kier and through inlets into the kier when feeding-in the rope of cloth by means of said liquid. The rope of cloth is fed-in into a drum pivoted in the kier, is moved together with this drum along a part of the circumference of said kier and is removed from the drum in order to be repeatedly fed-in. The treating liquid is removed from the drum after the feeding-in of the rope of cloth, and that part of the rope of cloth which is actually within the drum is deposited therein in a non-floating state.

20 Claims, 2 Drawing Figures

APPARATUS FOR WET-TREATING FABRICS

BACKGROUND OF THE INVENTION

The present invention concerns a new and improved apparatus for wet-treating, particularly for dyeing, a fabric in the form of a continuous circulating rope of cloth, wherein the rope of cloth is fed into a kier by introducing it by means of a treating liquid and is moved farther within the kier, and the treating liquid is circulated through outlets out of the kier and through inlets into the kier when feeding-in the rope of cloth by means of said liquid.

The apparatus comprises a kier for taking-up a considerable length of the rope of cloth; a feeding-in device for the introduction of the rope of cloth into the kier by means of the treating liquid; and a circulation pump for the liquid having its suction side fitted onto the kier and its pressure side fitted onto the feeding-in device.

In all heretofore known cases, the moving of the cloth farther within the kier is effected by means of the treating liquid circulating in the kier, and in which the cloth floats more or less completely immersed. After being removed from the liquid, the cloth is fed into an intensive processing section, at the end of which the cloth is again fed into the kier. The feeding-in of the cloth into the intensive processing section is effected by means of the liquid pumped out of the kier and into the intensive processing section. A considerable disadvantage of this prior art method of processing arises from the fact that the equipment for carrying out the processes require very high liquid ratios, so that there arises the further disadvantage of high energy consumption which is necessary for obtaining the possibly required high temperature of the treating liquid.

Devices of the type described above are also known in different constructional manifestations. Generally, these devices make use of a locomotive-kier or a similarly arranged kier, which is possibly equipped with interior installations. As a rule, these kiers are arranged horizontally and are not completely flooded with the treating liquid. Further, there is a feeding-in device mounted at one end of these kiers, which serves to feed the cloth into an intensive processing section, which is generally pipe-shaped, by means of the circulating treating liquid. This intensive processing section discharges into the other end of the kier. The circulation of the treating liquid is effected by means of a pump which is connected to the kier on one side and to the feeding-in device on the other side. Generally, the cloth in the kier is taken-up out of the treating liquid by a winch which leads the cloth to the feeding-in device. The latter often is a ring-nozzle feeding-in device emptying itself into the intensive processing section which is a pipe. For this purpose, the inlet opening of the pipe is usually enlarged into a funnel-shape, in order to enable the taking-up of the cloth running-off the winch. This funnel is surrounded by a ring-shaped chamber closed from the outside and into which discharges the pressure side of the pump and pumps in the treating liquid. The aforesaid ring-shaped chamber or room is connected to the inside of the pipe by continuous apertures or separate equivalent openings, so that the liquid entering the pipe from the ring-shaped chamber pulls the cloth into the pipe, whereafter the cloth together with the treating liquid floats away. A considerable disadvantage of these devices is their great capacity, which, in turn, requires extremely high liquid ratios.

Attempts have already been made to carry on development of such devices in order to improve the liquid ratios. In this respect it has particularly been proposed to make the kier L-shaped and to completely flood it, one strut or leg of the L-shape being horizontal whereas the other strut of the L-shape is essentially perpendicular. Consequently, a constructional size of the total device can be realized which, in connection with the complete flooding of the kier and the immersed floating of the cloth, permits obtaining improved liquid ratios. Nevertheless, this device also is still in no way satisfactory with respect to the liquid ratio.

SUMMARY OF THE INVENTION

Now, a primary object of the present invention is to improve and further develop the apparatuses of the type described above, so as to obtain more favorable liquid ratios with all their resulting beneficial consequences.

According to the invention, this object is realized in that the rope of cloth is fed-in into a drum pivoted in the kier, is moved together with this drum along a part of the circumference of said kier, and is removed from the drum in order to be repeatedly fed-in. Further the treating liquid is removed from the drum after the feeding-in of the rope of cloth, and that part of the rope of cloth which is actually within the drum is deposited therein in a non-floating state.

By virtue of this inventive improvement, there are required only relatively very small amounts of liquid. This is due to the fact that the dripping wet cloth is moved farther, without floating in the liquid, after it has been fed into the drum and deposited in the same. Almost the total amount of liquid so far necessary for the transport of the cloth through the kier can be completely omitted. The amount of liquid only has to be large enough to ensure for a regular feeding-in of the cloth into the drum and likewise a regular uninterrupted circulation of the treating liquid. Whilst so far the kier was of a very large size and was completely or at least to a considerable extent partially flooded, now according to the invention, the drum following the feeding-in device, the latter of which at the same time acts as the intensive processing section, is essentially empty of treating liquid. The amount of treating liquid present in the drum is the difference between the amount of liquid fed in by the feeding-in device and the amount of liquid removed from the drum, and thus the amount of liquid consumed for making the cloth contained in the moving drum dripping wet.

An advantageous embodiment of the invention is characterised in that the rope of cloth is fed into the drum through the peripheral wall of the same, and is likewise removed from the drum through the peripheral wall of the same. This type of introduction of the cloth into the drum has various advantages which are based on the constructional form of the corresponding apparatus which can be realised. In this respect, reference is made to the explanations regarding the apparatus as given below.

With respect to the apparatus, the object of the invention is realized in that a drum is pivoted in the interior of the kier; the rope of cloth by means of said feeding-in device may be introduced exclusively into this drum; and that the possibility is provided for that the treating liquid can pass from the inside of the drum into that part of the interior of the kier which is situated outside the drum.

The feeding-in device thus empties directly into the rotating drum pivoted in the kier. The feeding-in device at the same time acts as the intensive processing section, and the wet-treating of the cloth takes place almost exclusively in said feeding-in device, since the cloth, apart from the treating liquid which is retained by it during its residence time in the drum, is stored in the drum in a quasi dry, i.e. in a dripping wet state. As no floating movement of the cloth can take place, because of the special deposition of the cloth in the drum, the rotating arrangement of the drum is provided for as a substitute for it, so that the cloth which was fed into the drum by the feeding-in device, after having been moved farther together with the drum, can be guided again to the feeding-in device. The construction of the apparatus according to the invention results in a very compact form, so that very low liquid ratios will be obtained, even with an unforeseen flooding of the apparatus. Since, however, the apparatus according to the invention is not filled with liquid, as a result of the quasi dry moving farther of the cloth together with the drum, extremely favorable liquid ratios are obtained, especially considering the fact that the drum occupies the greatest part of the total volume of the apparatus.

According to an advantageous embodiment of the apparatus, the drum is freely pivoted and is freely rotating, and under the influence of the drawing-in of the rope of cloth, which is carried out by means of the feeding-in device, is set in motion. Such rotation of the drum which is free from any external impetus is based upon the fact that the feeding-in device removes the cloth from one side of the drum and leads it to the other side of the same, so that the drum rotates to the extent of removal and re-introduction of the cloth.

Alternatively, however, the drum may be driven from the outside or externally, e.g. by means of a motor. Such an external driving movement or impetus of the drum allows the pressure provided in the feeding-in device for the feeding-in of the rope of cloth into the drum to be reduced, which may be advantageous with certain qualities of cloth to be treated.

Moreover, with respect to providing the possibility that the treating liquid can pass from the interior of the drum into that part of the interior of the kier which is situated outside the drum, it is advantageous to provide the drum wall with sieve- or perforation-like interruptions or breaks. In this case, the drum looks somewhat like the washing drum of a washing machine.

Advantageously, the drum is mounted in the kier on a shaft or spindle. This shaft is preferably a sleeve shaft in order to allow the simultaneous introduction of further treating fluids, e.g. steam, into the interior of the drum. In this case the sleeve shaft should be surrounded, in the area of the drum, by a perforated cylinder for evenly distributing said further treating fluid, e.g. steam.

In order to ensure a simple and easy withdrawal of the cloth from the drum, it is essential that the laying aside of the cloth in the drum is effected without entanglements or interweavings. To this end, advantageously a folding device for the rope of cloth is installed beneath the feeding-in device. This folding device is preferably movably mounted.

A particularly preferred embodiment of the apparatus is characterised in that the drum consists of two separate halves which are axially spaced so as to provide a gap therebetween, and that the feeding-in device is installed in the area of this gap. This embodiment permits entrance of the drum through its peripheral rotary wall. This is of special advantage if several particularly arranged drums are to be installed next to each other and if a separate rope of cloth is to be treated in each drum.

In this connection, the arrangement can be constituted such that the feeding-in device is essentially mounted outside the drum and in the area of the abovementioned gap. Since only the upper half of the drum is available as space for the feeding-in device, if the latter is to be mounted in the interior of the drum, and since some minimum length of the feeding-in device cannot be further reduced, the aforementioned embodiment permits the use of a drum having such a small diameter that this diameter does not permit the housing of the feeding-in device in the interior of the drum. Particularly, if for some reason or other the feeding-in device shall have a considerable constructional length, it is recommended to interpose a winch for taking up the rope of cloth coming out of the drum and for transferring it to the feeding-in device.

BRIEF DESCRIPTION OF THE DRAWINGS

Hereafter, the invention is further illustrated in particular with reference to the drawings, in which a preferred embodiment of the apparatus according to the invention is shown. In the drawings.

DETAILED DESCRIPTION OF THE INVENTION

Figure 1:
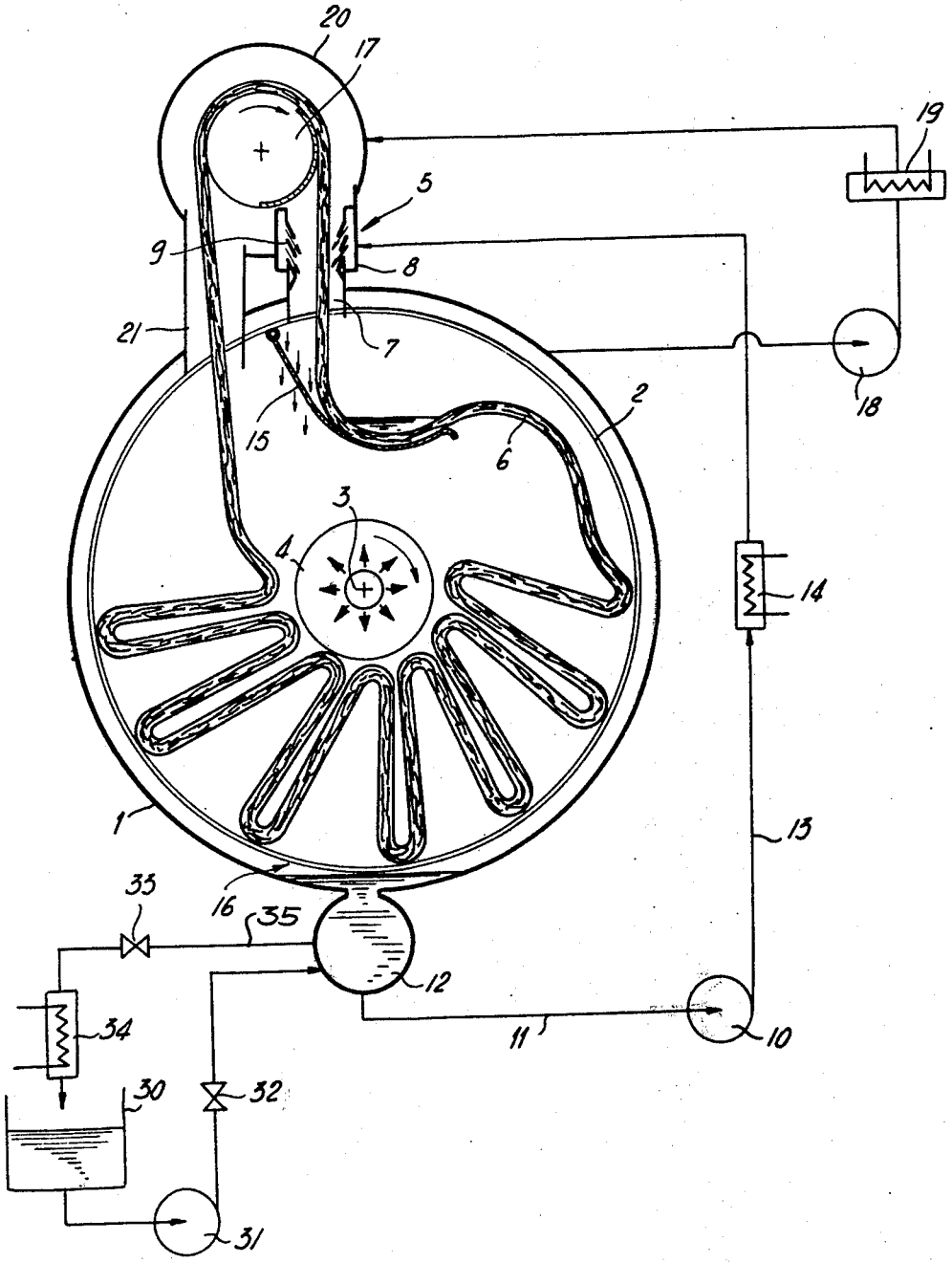
FIG. 1 is a cross-section through a preferred embodiment of the invention.

As shown in FIG. 1, the illustrated exemplary embodiment of the apparatus comprises, on the one hand, a kier 1 and, on the other hand, a drum 2 of the rotary type. Drum 2 is mounted in kier 1 on a spindle or shaft 3 which is a sleeve shaft and is surrounded by a perforated cylinder 4. This construction of spindle 3 provides the possibility of introducing steam into the interior of the drum, this steam being evenly distributed in the interior of the drum 2 by means of perforated cylinder 4. The mutual arrangement of drum 2 and spindle 3 will be more fully explained below with reference to FIG. 2.

Continuing, in the upper part of the apparatus there is mounted a feeding-in device 5, by means of which a rope of cloth 6 can be fed into the interior of drum 2 with the aid of the treating liquid. This feeding-in or delivery device 5 consists of a stub 7 of kier 1 and a ring-shaped chamber or room 8 which is connected to the interior of stub 7 via a flow director 9. A circulation pump 10 is arranged so that its suction side 11 is connected via a collecting pipe 12 to the outlet for the treating liquid at the underside of kier 1, and its pressure side 13 is connected via a heat exchanger 14 with the ring-shaped chamber or room 8 of feeding-in or delivery device 5.

The introduction of the rope of cloth 6 into the interior of drum 2 occurs in such a way that the treating liquid which is delivered to ring-shaped chamber 8 via the pressure side 13 of the circulation pump 10 enters the interior of stub or pipe section 7 via flow director 9, thereby transporting the rope of cloth 6 and taking it into the interior of the drum 2.

On the admission side of feeding-in device 5, there is slewably or pivotably mounted a folding device 15 having the form of a perforated tray. The purpose of this folding device 15 is clearly seen from the drawing, i.e. to distribute the rope of cloth by piling it up on the inner wall of drum 2. The perforations of folding device 15 serve the purpose of allowing the treating liquid flowing into the drum interior via feeding-in device 5 to drain as soon as possible downwards, where it is then directed via collecting pipe 12 from kier 1 to circulation pump 10. A water-gauge 16 of the treating liquid is controlled, by means of circulation pump 10, so that no treating liquid is present in the interior of drum 2. This means that the treatment of the rope of cloth 6 takes place in the area of feeding-in or delivery device 5.

Finally, according to the showing of FIG. 1, a winch 17 is mounted above feeding-in device 5, over which there is passed the rope of cloth 6 coming out on the interior of drum 2 before being introduced into feeding-in device 5.

In FIG. 1 there is also provided an air-circulation system 18 which is fitted on the one hand on kier 1 and, on the other hand, via a heat exchanger 19, on a casing 20 in which winch 17 is arranged and which is connected to the interior of kier 1 by stub 7 of feeding-in device 5 and by a further stub or pipe section 21, which permits the rope of cloth 6 to pas onto winch 17.

The transportation of the rope of cloth 6 coming out of the interior of drum 2 back to said interior of the drum 2 may also be effected without any exterior transporting device, exclusively by means of a feeding-in device 5 which is a Venturi tube.

In order to allow the continuous or batchwise addition of water or chemicals to the treating liquid, the device also comprises an open reservoir 30 which is connected to kier 1 or to the external circuit means 12, 11, 10, 13, 14 of the treating liquid, via a pump 31 and a non-return flap or valve 32. In order to further allow the continuous addition of chemicals to the treating liquid while at temperatures above its boiling point, the device further comprises means for by-passing part of the treating liquid circulating in said external circuit 12, 11, 10, 13, 14 into open reservoir 30, said means comprising a pressure-reducing valve 33, a cooler 34 and a supply pipe 35.

Figure 2:
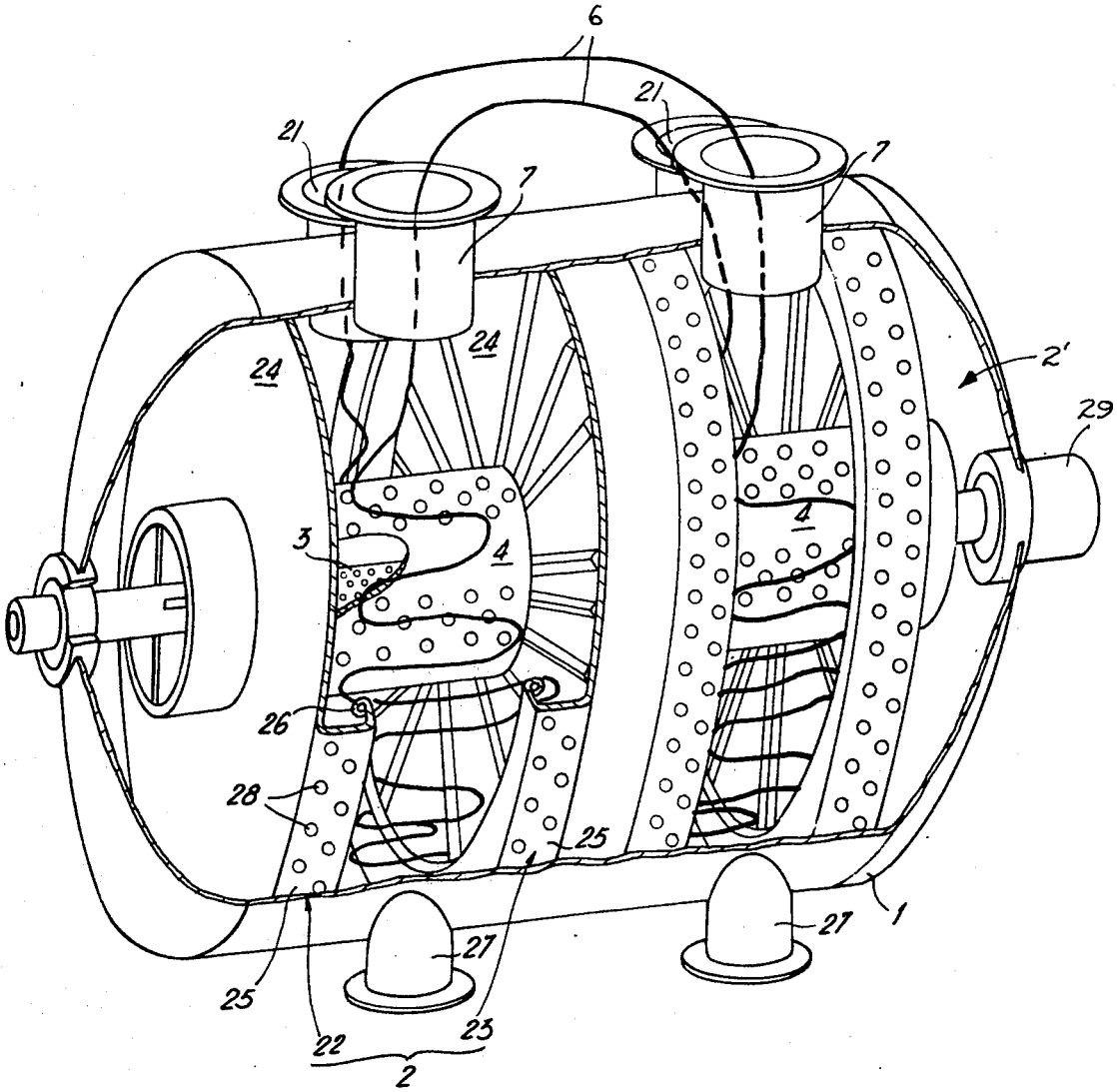
FIG. 2 is a partially broken-away perspective view of an apparatus according to the invention having two drums.

FIG. 2 shows another embodiment of the apparatus according to the invention which is constructed according to the principles of FIG. 1, but comprises two drums 2 which are axially arranged one after the other. Several details of the device shown in FIG. 1 are omitted in FIG. 2, whereas other details are shown in FIG. 2. In particular, FIG. 2 shows the subdivision of each drum 2 into two separate halves 22 and 23 facing each other and axially spaced from one another a distance sufficient to permit introduction of the cloth into the drum. Each drum half 22 and 23 consists, on the one hand, of a front piece or element 24 and, on the other hand, of a peripheral rotary wall 25. The inner edges of both peripheral rotary walls 25 of each drum half 22 and 23 are inwardly bordered or flanged, so as to form a retaining rim 26. The rotary walls 25 of each drum half 22 and 23 are perforated to ensure the free exhaustion of the treating liquid in the direction of collecting tube 12 (see FIG. 1) which is fitted on support 27 of kier 1. These perforations which permit the flowing-through of the treating liquid are designated by reference character 28. Although the gap between the two rotary walls of the drum halves 22 and 23 already provides a possibility of throughflow in this area, this is not sufficient since rim 26 is bordered inwards. For this reason, there are additionally provided the perforations 28. The task of rim 26 is to prevent the cloth which is deposited on the inner wall of the rotary wall 25 from becoming streaked or rubbed on the inner wall of kier 1 during the rotation of drum 2 in kier 1.

In FIG. 2, the rope of cloth 6 is represented schematically as a thin line for the purpose of illustrating its travel path through the apparatus rather than to show its physical dimensions. It will be appreciated that the rope of cloth 6 may be greater in width than the openings of stubs 7 and 21. In this way when the rope of cloth 6 enters the stub opening there occurs a reduction in the width of the cloth to correspond to the stub opening. However, when the rope of cloth 6 exits the stub opening and begins its travel into drum 2, the rope of cloth 6 opens, or balloons out, by virtue of the liquid escaping therefrom, its weight, and the normal tendency of the somewhat compressed rope to open when the restraint is removed. As the rope of cloth 6 descends into the drum it begins to pile up on the gap and brides the gap between drum halves 25, 27, as illustrated in FIG. 2.

The apparatus illustrated in both figures are so constructed that drums 2 are freely rotatable in kier 1. The movement of drum 2 in kier 1 thereby results exclusively from the influence of the weight of rope of cloth 6 which is brought into the interior of drum 2 by the feeding-in device 5. To this end, the friction between the inner drum wall and the rope of cloth 6 is sufficient.

On the other hand, if the drum 2 is motor-driven, no modifications of the shown equipment are necessary other than the provision of a suitable motor 29, as shown in FIG. 2.

According to a further embodiment of the invention, the apparatus comprises several units of the kind described above, connected in parallel or series. As also illustrated in FIG. 2, the rope of cloth runs from one drum 2 into another drum 2' and is guided in a closed circuit back to the first drum 2 in the directions indicated by the arrows.

While there is shown and described present preferred embodiments of the invention, it is to be distinctly understood that the invention is not limited thereto, but may be otherwise variously embodied and practiced within the scope of the following claims.

What is claimed is:

1. An apparatus for wet-treating, particularly for dyeing, a fabric in the form of a continuous circulating rope of cloth, comprising a kier for taking up a considerable length of rope of cloth, a feeding-in device for the introduction of the rope of cloth into the kier by means of a treatment liquid, a circulating pump for the treatment liquid having its suction side fitted onto the kier and its pressure side fitted onto the feeding-in device, a drum rotatably mounted in the interior of the kier, said drum having a wall including throughpassage means for introducing the rope of cloth interiorly of said drum, the rope of cloth, by means of said feeding-in device, being introduced exclusively into said drum and means for enabling the treatment liquid to pass from the inside of the drum into that part of the interior of the kier which is situated outside the drum.

2. The apparatus according to claim 1, wherein the drum is freely rotatable under the influence of the rope of cloth introduced into the interior of the drum by means of the feeding-in device.

3. The apparatus according to claim 1, including means located externally of said drum for rotating said drum.

4. The apparatus according to claim 1, wherein said means enabling passage of the treatment liquid includes perforation-like interruptions provided in said drum wall in order to allow the passing of the treatment liquid from the interior to the outside of the drum.

5. The apparatus according to claim 1, wherein the drum is rotatably mounted in the kier by means of a spindle.

6. The apparatus according to claim 5, wherein the spindle is a sleeve shaft allowing the introduction of further treatment fluids into the interior of the drum.

7. The apparatus according to claim 6, wherein the further treatment fluids include at least steam.

8. The apparatus according to claim 6, wherein the sleeve shaft is surrounded in the area of the drum by a perforated cylinder for evenly distributing said further treating fluids.

9. The apparatus according to claim 1, further comprising a folding device for the rope of cloth arranged beneath the feeding-in device.

10. The apparatus according to claim 9, wherein the folding device is movably mounted.

11. The apparatus according to claim 1, wherein the drum comprises two separate halves axially spaced so as to provide a gas therebetween, and said feeding-in device is arranged in the area of said gap.

12. The apparatus according to claim 11, wherein the feeding-in device is essentially arranged outside the drum.

13. The apparatus according to claim 11, wherein each half of the drum has an edge which edges are facing each other and which are radially bordered inwards so as to provide a retaining rim for the rope of cloth.

14. The apparatus according to claim 1, wherein said feeding-in device includes a Venturi tube comprising the exclusive means for effecting continuous circulation of the rope of cloth coming out of the interior of the drum back to said interior of the drum.

15. The apparatus according to claim 1, further including an open reservoir which is connected to the kier of the treatment, via a pump and a non-return valve, in order to allow the addition of water or chemicals to the treatment liquid.

16. The apparatus for wet-treating, particularly for dyeing, a fabric in the form of a continuous circulating rope of cloth, according to claim 1, wherein there are provided a number of said apparatuses connected to each other, the rope of cloth running from one drum into another and being guided in a closed circuit back to the first apparatus.

17. The apparatus according to claim 1, further including an open reservoir which is connected to an external circuit of the treatment liquid, via a pump and a nonreturn valve, in order to allow addition of water or chemicals to the treatment liquid.

18. The apparatus according to claim 17, further including means for by-passing part of the treatment liquid circulating in the external circuit into the open reservoir, said means comprising a pressure-reducing valve, a cooler and a supply pipe, in order to allow the continuous addition of chemicals to the treatment liquid while being at temperatures above its boiling point.

19. An apparatus for wet-treating, particularly for dyeing, a fabric in the form of a continuous circulating rope of cloth, comprising a kier for taking up a continuous circulating rope of considerable length, in-feed means for feeding the rope of cloth into the kier, a pump for circulating a treatment liquid, said pump having a suction-side connected to the kier and a pressure side connected to said in-feed means, a drum arranged interiorly of said kier, means for rotatably mounting said drum in said kier, said drum including means for introducing the rope of cloth interiorly of said drum during rotation thereof and including means in said drum enabling the passage of treatment liquid from the interior of said drum.

20. The apparatus according to claim 19 wherein said drum includes a peripheral wall, said means for introducing the rope of cloth interiorly of said drum including a circumferential gap in said peripheral wall.

* * * * *